United States Patent [19]

Pasternack

[11] Patent Number: 4,551,858

[45] Date of Patent: Nov. 12, 1985

[54] PROTECTIVE HELMET HAVING A COOLING HARNESS

[75] Inventor: Adalbert Pasternack, Bad Schwartau, Fed. Rep. of Germany

[73] Assignee: Drägerwerk Aktiengesellschaft, Fed. Rep. of Germany

[21] Appl. No.: 574,993

[22] Filed: Jan. 30, 1984

[30] Foreign Application Priority Data

Jan. 28, 1983 [DE] Fed. Rep. of Germany ..... 3302785

[51] Int. Cl.[4] ..... A42B 3/00

[52] U.S. Cl. ..... 2/7; 2/413; 2/171.2

[58] Field of Search ..... 2/7, 413, 412, 411, 2/414, 415, 417, 418, 419, 190, 171.2, 171.3

[56] References Cited

U.S. PATENT DOCUMENTS

| | | | |
|---|---|---|---|
| 2,049,723 | 8/1936 | Pomeranz | 2/7 X |
| 3,025,525 | 3/1962 | Larson | 2/419 |
| 3,090,045 | 5/1963 | Hurst | 2/7 |
| 3,462,763 | 8/1969 | Schneider et al. | 2/413 |
| 3,600,714 | 8/1971 | Cade et al. | 2/413 X |
| 3,806,950 | 4/1974 | Foote | 2/413 |
| 3,882,547 | 5/1975 | Morgan | 2/414 |
| 4,483,021 | 11/1984 | McCall | 2/7 |

FOREIGN PATENT DOCUMENTS

| | | | |
|---|---|---|---|
| 2387611 | 11/1978 | France | 2/413 |
| 1578351 | 11/1980 | United Kingdom | 2/412 |

*Primary Examiner*—Peter Nerbun

*Attorney, Agent, or Firm*—McGlew and Tuttle

[57] ABSTRACT

A protective helmet has its head harness constructed as a cooling gear. The harness forms a lining of the inside of a helmet shell and comprises two elastic sheets connected to each other by seams. The sheets are cut to double segments which are connected to each other at the top by an annular channel. The double segments are divided by longitudinal and transverse webs to form communicating cells. The space between the sheets is filled with a coolant which is introduced through annular channel in a liquid state. The double segments are connected to each other by a cross band through which the head harness is buttoned in, onto retaining buttons inside the helmet. To cool down, the harness can easily be unbuttoned and later put in place again in the same simple manner.

7 Claims, 4 Drawing Figures

PROTECTIVE HELMET HAVING A COOLING HARNESS

FIELD AND BACKGROUND OF THE INVENTION

The invention relates in general, to protective wearing apparel and in particular to a protective helmet equipped with a cooling gear which is formed by two foils or sheets sealed to each other to form cells receiving a coolant.

While attempting to provide a healthier ambience for people working under exposed physical conditions, the protection of the head is important. The mechanical protection with the helmet is generally satisfactory. The control of the ambient physical conditions is still wanting, however.

Prior art protective helmets are commonly equipped with a head harness ensuring a satisfactory seat of the helmet. Intermediate space forms between the helmet shell and the harness, permitting air to circulate. This provides a certain cooling. At hot working places, such as in foundries, coking plants and also for drivers of sports cars, this cooling is not satisfactory.

A special system for keeping low temperature, to be used on a user's head too, comprises a plastic tempering mixture of various chemicals with a high water content, enclosed in hot-sealed cells formed between flexible sheets. If such a system is worn on the user's body, it may exchange large heat amounts with the ambience, without thereby appreciably changing its initial temperature or mechanical properties. The system may be provided with a permanent filling of the tempering mixture, or with a closable opening for refilling. For wearing on the user's head, the array of sealed cells forms a hood structure which is held in place by a harness (U.S. Pat. No. 3,463,161).

A combination with a mechanical protection of the head is not provided. A use with a conventional protective helmet requires an adjustment of the fittings and prevents the cooling surfaces from applying against the head uniformly.

A prior art cooling vest comprises a waist portion and a hood portion. Both portions are provided with passages for a liquid coolant which is then circulated therethrough and cooled in a unit worn on the user's back. The flow passages are formed by sheets of plastic which are hot-sealed together, and silicone oil is employed as the coolant. In the hood portion, the flow passages are held in their needed shape by a cap-like carrier. On top of the hood portion, a conventional protective helmet is worn having its harness adjusted to a corresponding volume (assignee's periodical Drägerheft 310 January–April 1978, pages 13–24).

With an improper adjustment of the harness, the circulation of the coolant may be obstructed. Because of the harness, the cooling surfaces apply against the head non-uniformly, with the result of an inadequate distribution of the cooling effect. In view of the connections to the cooling unit, the hood portion can hardly be used separately.

SUMMARY OF THE INVENTION

The invention is directed to a protective helmet including a cooling system ensuring a satisfactory seat of the helmet on the head and at the same time a sufficient cooling.

In accordance with the invention, a protective cooling helmet comprises an outer shell and an inner hollow removable lining having a coolant therein and arrangeable within the shell. Securing means for securing the lining into the shell includes engageable button and buttonholes which advantageously includes a button-like formation at the interior of the outer shell at spaced locations which are engageable into openings or buttonholes of an intermediate cooling containing double wall and an outer insulating casing.

The inventive protective helmet is particularly suitable for sensitive users. By means of an insulating casing which can additionally be buttoned in over the head harness, without any further provision, the transfer of the cooling effect to the user can be damped. The casing also acts as a padding.

The primary advantage of the invention is that the helmet remains well fitted to the user's head, due to the utilization of the harness which is present and necessary anyway. The inventive buttoning in through retaining buttons extremely simplifies and eliminates any problems in the handling before use.

Accordingly it is an object of the invention to provide an improved helmet construction which comprises an outer protective shell and a lining engageable in the shell which has an hollow interior filled with a coolant.

A further object of the invention is to provide a helmet which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
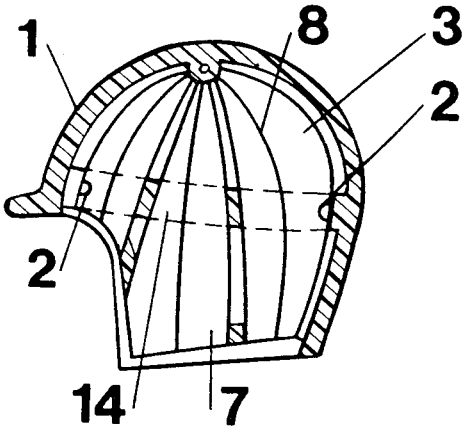
FIG. 1 is a sectional view of a protective helmet equipped with a cooling harness.
Figure 2:
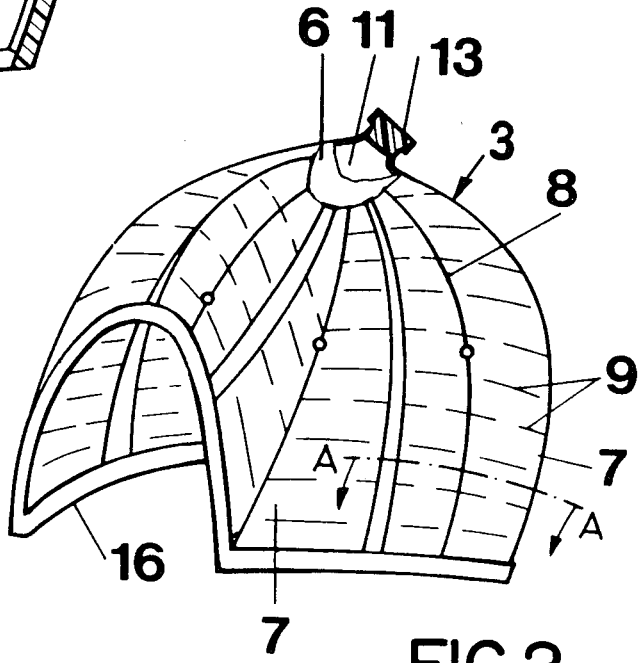
FIG. 2 is a front perspective view of the cooling harness.
Figure 4:
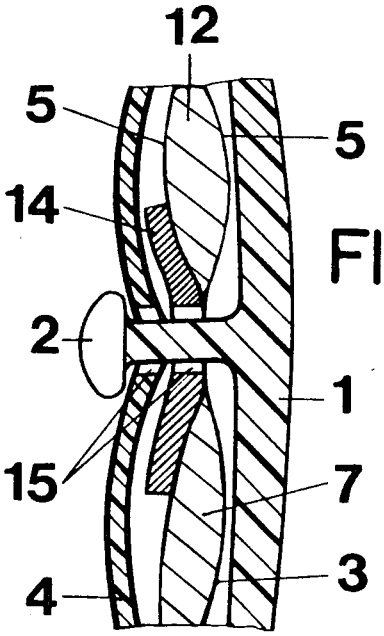
FIG. 4 is an enlarged sectional view of the helmet showing how the head harness is suspended inside the helmet.
Figure 3:
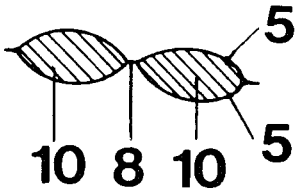
FIG. 3 is a sectional view of a cooling segment.

Referring to the drawings in particular the invention embodied therein comprises a protective cooling element which comprises an outer protective shell 1 and an inner hollow removable lining in the form of a head harness generally designated 3 which is advantageously made up of two elastic sheets 5, 5 which are constructed to have a hollow interior filled with a coolant 12. Securing means in the form of interengageable buttons and holes advantageously comprises a retaining button formation 2 at a plurality of locations at the interior of the helmet which engage through openings 15 in the head harness and in an outer insulating casing 4 which overlies the harness and is arranged adjacent the wearer's head. In according with a preferred embodiment of the invention, a cross band 14 is also provided with a buttonhole 15 and it extends around the interior of the helmet under the buttons 2.

The protective helmet comprises a helmet shell 1 and a head harness 3 which is buttoned at the inside of the shell onto retaining buttons 2. Harness 3 is at the same time designed as a cooling means. An additional insulating casing 4 suspended from the same retaining buttons 2 improves the wearing comfort.

Head harness 3 comprises two elastic sheets 5 which are cut as walled segments 7 and connected to each other in the top zone by an annular channel 6. Double walled segments 7 are divided to smaller partial chambers or cells 10 by longitudinals 8 webs, and transverse discontinuous webs 9, so that the harness can well adapt to fit both the head and the helmet. Annular channel 6 communicates with all the cells 10. Filling of cells 10 with a coolant 12 is effected through an opening 11. The coolant is introduced in liquid state whereupon opening 11 is closed with a plug 13. After cooling out, which process makes the coolant 12 plastic or even solid while the harness 3 still remains conformable due to the provision of longitudinal and transverse webs 8,9, the filled harness is buttoned onto retaining buttons 2 in helmet shell 1. For this purpose, double segments 7 are connected to each other at the level of retaining buttons 2 by means of a crossband 14 which is provided with corresponding buttonholes 15.

To still improve the wearing comfort, insulating casing 4 is buttoned in addition onto the same retaining buttons 2.

Head harness 3 may be provided on its hem or rim with an elastic strip 16 by which double segments 7 are connected to each other.

While a specific embodiment of the invention has been shown and described in detail to illustrate the application of the principles of the invention, it will be understood that the invention may be embodied otherwise without departing from such principles.

What is claimed is:

1. A protective helmet having cooling gear comprising an outer protective helmet shell and a head harness arranged within said shell comprising inner and outer lining walls formed as complimentary segments connected to each other adjacent the tops thereof, said segments being subdivided by longitudinal and transverse webs into mutually communicating cells, a coolant in said cells, a crossband additionally connecting said segments together extending around said helmet, said crossband and said lining having openings therein and a button formation at the interior of said outer protective helmet engaged in the openings.

2. A protective helmet according to claim 1, including an insulating casing arranged on the interior of said helmet overlying said liner and having buttonholes into which the button formations are engaged.

3. A protective helmet according to claim 1, including an elastic strip interconnecting said lining outer and inner walls around the peripheries thereof.

4. A protective cooling helmet, comprising an outer shell, an inner double walled hollow removable lining having a coolant therein forming a head engageable harness arrangeable within said shell, said lining comprising outer and inner segmental portions which are interconnected so as to leave a hollow coolant chamber therebetween, a plurality of button formations formed around an interior of said shell, said lining having button hole openings engaged on the button formations, a crossband extending around the helmet having buttonholes engageable on the button formations over said lining, and an insulating casing having buttonholes engaged on said button formations and overlying said crossband and said lining on the interior of said shell.

5. A protective cooling helmet according to claim 4, including an elastic strip connected to a periphery of said lining.

6. A protective cooling helmet comprising:

an outer shell defining an interior space and having a band area around said interior space with a plurality of button formations projecting inwardly from said band area;

a lining having a plurality of button holes each engaged onto one of said button formations, said lining extending over said shell in said interior space, said lining comprising a pair of elastic sheets connected to each other at a plurality of longitudinal webs and at a plurality of discontinuous transverse webs to define a plurality of communicating cells between said sheets, one of said sheets having an opening therein near a top of said lining with a plug in said opening;

a liquid coolant filling said cells; and a crossband extending over said band area and over said lining in said band area, said crossband having a plurality of buttonholes each engaged on one of said button formations.

7. A protective cooling helmet according to claim 6, including an insulating casing including a plurality of buttonholes each engaged on one of said button formations, said insulating casings lying over said lining in said interior space.

* * * * *